US007882737B2

(12) United States Patent
Coats et al.

(10) Patent No.: US 7,882,737 B2
(45) Date of Patent: Feb. 8, 2011

(54) FOLDABLE MEASURING CONTAINER

(75) Inventors: Alfred C. Coats, Houston, TX (US); Don Gaither, Milwaukie, OR (US)

(73) Assignee: Life-Tech, Inc., Stafford, TX (US)

( * ) Notice: Subject to any disclaimer, the term of this patent is extended or adjusted under 35 U.S.C. 154(b) by 202 days.

(21) Appl. No.: 11/903,031

(22) Filed: Sep. 20, 2007

(65) Prior Publication Data

US 2008/0086102 A1 Apr. 10, 2008

Related U.S. Application Data

(60) Provisional application No. 60/846,645, filed on Sep. 22, 2006.

(51) Int. Cl.
*G01F 19/00* (2006.01)
*B65D 5/56* (2006.01)

(52) U.S. Cl. ..... 73/426; 229/117.34

(58) Field of Classification Search ..... 229/117.27, 229/117.3, 117.34, 117.35; 73/426
See application file for complete search history.

(56) References Cited

U.S. PATENT DOCUMENTS

| | | | | |
|---|---|---|---|---|
| 3,003,678 | A * | 10/1961 | Chase | 229/117.13 |
| 3,756,471 | A | 9/1973 | Wissman | |
| 5,197,625 | A * | 3/1993 | Mullaney | 229/117.3 |
| 5,425,468 | A | 6/1995 | Birkel et al. | |
| 5,516,038 | A * | 5/1996 | Zaccarini | 229/162.2 |
| 6,568,587 | B1 * | 5/2003 | Yamada et al. | 229/162.1 |
| 2004/0084457 | A1 | 5/2004 | Bartlett | |

FOREIGN PATENT DOCUMENTS

| | | |
|---|---|---|
| CA | 2350630 | 5/2000 |
| EP | 1845022 | 10/2007 |
| GB | 1466854 | 3/1977 |
| GB | 2442142 | 3/2008 |
| JP | 06270958 | 3/1993 |
| JP | 10147368 | 11/1996 |
| WO | WO 2007/123446 | 11/2007 |

OTHER PUBLICATIONS www.orikaso.com pages regarding "Instructions", "Mug", and "Cup", May 22, 2006.
2002 Ohkura Pharmaceutical Co., Ltd., OK-CUP™ , Collapsible Measuring Urine Cup, International Journal of Urology 2001.
Centrum Healthcare website, "Tracheal Suction Cath 'N Sleeve ™ Two-Glove Kit", 2002, 2003.

* cited by examiner

*Primary Examiner*—John Fitzgerald
(74) *Attorney, Agent, or Firm*—Greenberg Traurig LLP; Ben D. Tobor

(57) ABSTRACT

Embodiments of the present invention provide for a foldable container adapted to measure a volume of liquid. The container comprises a box and a bag. The bag is preferably a substantially transparent plastic bag that lines an interior of the box. The box is convertible between a substantially flat configuration and a stable, volume-defining configuration. In one embodiment the box is a substantially transparent plastic box. In another embodiment the box is a paperboard or opaque plastic box having a window comprised of a substantially transparent material. One or more graduations are provided to indicate the volume of liquid in the container when the box is in the volume-defining configuration.

15 Claims, 2 Drawing Sheets

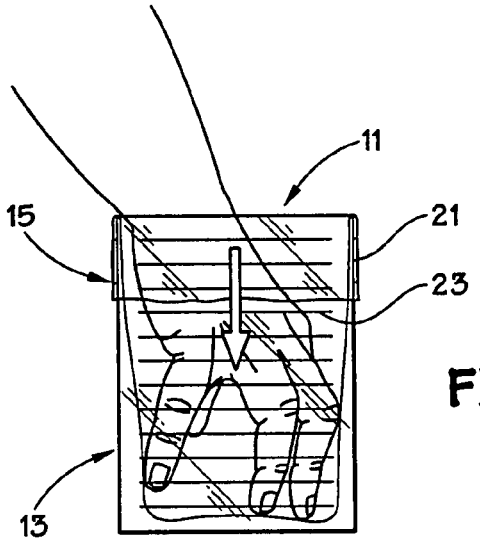
FIG. 5
FIG. 6
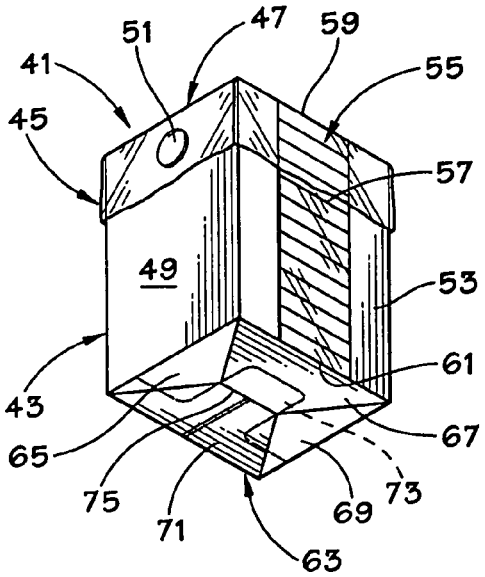
FIG. 7
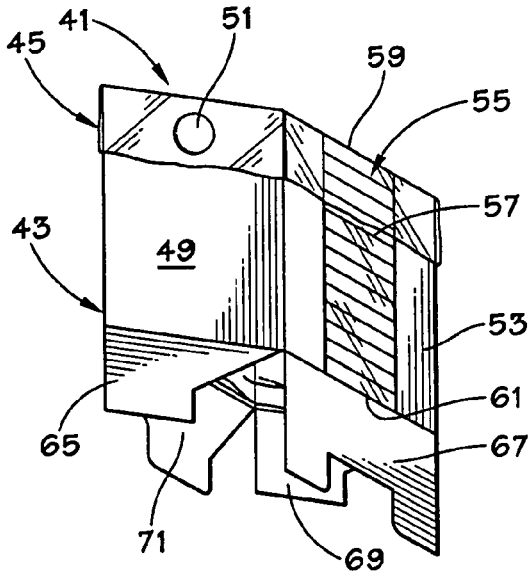

FOLDABLE MEASURING CONTAINER

RELATED APPLICATION

This Application claims the benefit, and priority benefit, of U.S. Patent Application Ser. No. 60/846,645, filed Sep. 22, 2006, entitled "Foldable Measuring Container".

BACKGROUND OF THE INVENTION

1. Field of the Invention

This invention relates generally to containers and, more specifically, to a folding urine measuring container.

2. Background of the Invention

A common administered diagnostic test is known as the bladder diary. In this test a patient measures the volume of urinations and records the measurements in a diary, which is typically kept over a one to seven day period. Significant problems with the test involve the measuring containers used by patients to measure their volume of urinations.

A first problem involves getting a measuring container to the patient. Typically, either a standard liquid measuring container is given or mailed to the patient, or the patient is asked to purchase a measuring container. If the container is given to the patient, the patient must visit the clinic before starting the diary. Not only is this inconvenient for the patient, but the measuring containers also create storage and inventory problems for the clinic due to the significant space required to store the containers. Mailing the container to the patient is expensive and inconvenient due to the size of the container. Patients who are asked to purchase a container often fail to take the time and effort to locate and purchase a container. Instead, they often refuse to keep the diary, or falsify or estimate their urine volumes. This lack of patient compliance can frustrate or mislead the physician who ordered the bladder diary.

A second problem involves use of the measuring container by the patient when the patient is not at home. Patients find it cumbersome and embarrassing to carry a typical measuring container with them in public places such as restaurants and stores. Patients who refuse to do so often produce inaccurate or incomplete diaries.

3. Description of the Related Art

Potential but unsatisfactory solutions to the problem of suitable containers for bladder diaries exist. One product is known as the pop-up container. This container comprises a paperboard box and a plastic bag. The pop-up container was designed as a solution container for use in tracheal suction. Thus the pop-up container has a very small capacity, but even if the capacity of the pop-up container were increased, it still has a number of significant problems. First, the pop-up container lacks any sort of graduations or measurement lines. This deficiency renders it nearly useless for the purpose of keeping a bladder diary. Second, the pop-up container is opaque so that, even if graduations were provided, the level of liquid inside the container cannot be easily or accurately determined. Finally, the pop-up container is prone to collapse if not held carefully by the user during use, which would lead to embarrassing and unsanitary results if such collapse occurred during its use to measure urine volume.

SUMMARY OF THE INVENTION

In one embodiment of the present invention, a container adapted to measure a volume of liquid is provided. The container comprises a box and a bag. The box preferably is a substantially transparent plastic box convertible between a substantially flat configuration and a stable, volume-defining configuration. The bag preferably is a substantially transparent plastic bag that lines an interior of the box. One or more graduations are provided to indicate the volume of liquid in the container when the box is in the volume-defining configuration.

In a further embodiment, a container adapted to measure a volume of liquid is provided. The container comprises a box and a bag. The box is convertible between a substantially flat configuration and a stable, volume-defining configuration. The box preferably includes a window comprised of a substantially transparent material and that extends from an upper edge of the box to a lower edge of the box when the box is in the volume-defining configuration. Aside from the window, the box preferably is comprised of a liquid-resistant paperboard. The bag preferably is a substantially transparent plastic bag that lines an interior of the box. One or more graduations are provided to indicate the volume of liquid in the container when the box is in the volume-defining configuration.

BRIEF DESCRIPTION OF THE DRAWINGS

Some of the features and benefits of the present invention having been stated, others will become apparent as the description proceeds when taken in conjunction with the accompanying drawings, in which:

FIG. 5 is a front view of the foldable measuring container of FIG. 1 according to the present invention.

FIG. 6 is a perspective view of a foldable measuring container according to the present invention.

FIG. 7 is a perspective view of the foldable measuring container of FIG. 6 in a substantially flat configuration according to the present invention.

DETAILED DESCRIPTION

The present invention now will be described more fully hereinafter with reference to the accompanying drawings in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
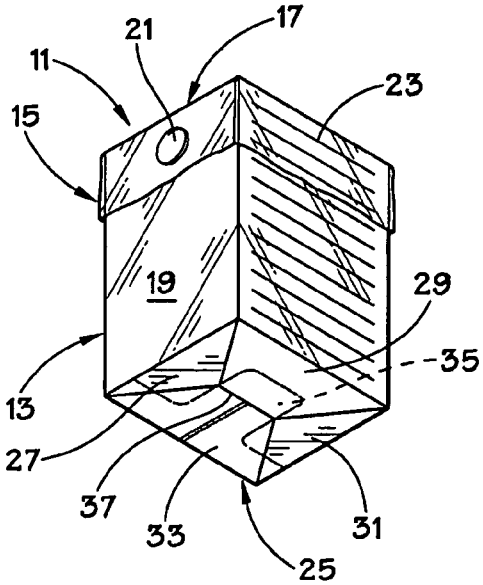
FIG. 1 is a perspective view of a foldable measuring container according to the present invention.

FIG. 1 is a perspective view of a foldable measuring container according to the present invention. Container 11 includes box 13 and bag 15. Bag 15 is sized to line interior 17 of box 13. Bag 15 preferably is composed of a liquid-impermeable, substantially transparent plastic. More preferably, bag 15 is composed of a liquid-impermeable, clear plastic and has a shape that conforms to the shape of interior 17 of box 13. Bag 15 may be attached to interior 17 or, more preferably, exterior 19 of box 13 by adhesive 21. Adhesive 21 may be applied in one or more locations, the specific locations illustrated in FIG. 1 serving only as an example. Adhesive 21, if used, helps to prevent bag 15 from becoming separated from box 13. In an alternative embodiment, a substantial portion of bag 15 may be bonded to box 13. In yet another embodiment, bag 15 may be replaced each time container 11 is used.

Box 13 is illustrated here in a stable, volume-defining configuration, but may be converted to a substantially flat configuration as described in more detail below. Box 13 preferably is composed of a substantially transparent material and, more preferably, of a substantially clear plastic material. Although box 13 is illustrated as having a rectangular shape, many shapes of box are within the scope of the invention. Box 13 includes one or more graduations 23 adapted to indicate the volume of liquid in container 11 when box 13 is in the volume-defining configuration. Graduations 23 preferably are printed on exterior 19 of box 13; however, any means of providing graduations is within the scope of the invention. For example, graduations 23 could be printed on interior 17 of box 13, or imprinted into interior 17 or exterior 19 of box 13. Container 11 preferably has a liquid capacity of about one liter when box 13 is in the volume-defining configuration.

Box 13 also includes bottom 25. Bottom 25 preferably includes at least two flaps adapted to interlock when box 13 is in the volume-defining configuration. In a preferred embodiment, bottom 25 of box 13 includes flaps 27, 29, 31, and 33. Flap 33 includes tongue 35. Flaps 27, 29, and 33 are adapted to form slot 37 when folded together. Tongue 35 of flap 33 is adapted to be inserted into slot 37 when box 13 is in the volume-defining configuration. The arrangement of flaps of bottom 25 preferably confers sufficient stability to box 13 that it can be handled confidently with only one hand. The stability of box 13 also permits accurate measurement of the volume of liquid in container 11. Although a specific design for bottom 25 is disclosed in detail herein, other designs for bottom 25 that are foldable and provide sufficient rigidity are within the scope of invention, as understood by those of skill in the art. The side of box 13 opposite bottom 25 preferably is left open, but could be fitted with a lid or additional flaps.

Figure 2:
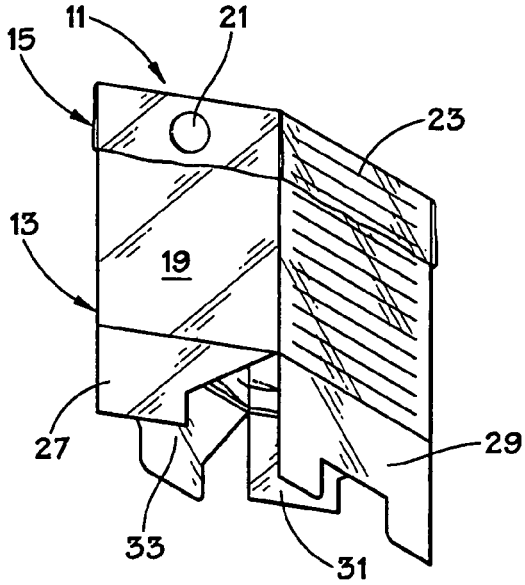
FIG. 2 is a perspective view of the foldable measuring container of FIG. 1 in a substantially flat configuration according to the present invention.

FIG. 2 is a perspective view of a foldable measuring container according to the present invention. In this illustration, box 13 is in a substantially flat configuration. Container 11 may be conveniently stored, shipped, or carried in the flat configuration. Bag 15 need not be removed from box 13 when in the flat configuration.

Figure 3:
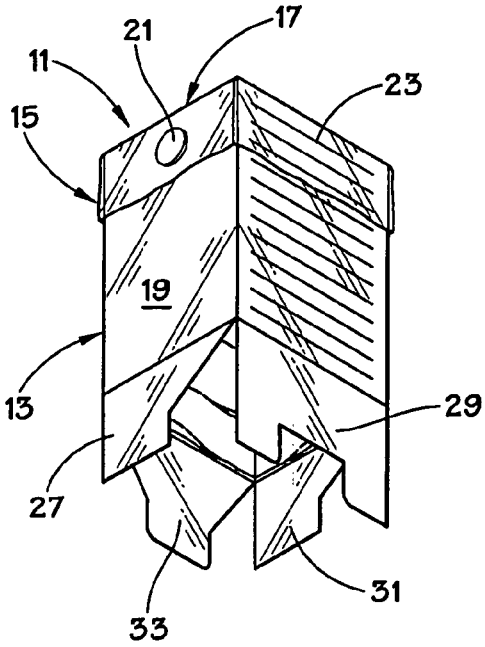
FIG. 3 is a perspective view of the foldable measuring container of FIG. 1 in a partially folded configuration according to the present invention.

FIG. 3 is a perspective view of a foldable measuring container according to the present invention. Box 13 is folded partially so that it is not flat, but flaps 27, 29, 31, and 33 are not interlocked.

Figure 4:
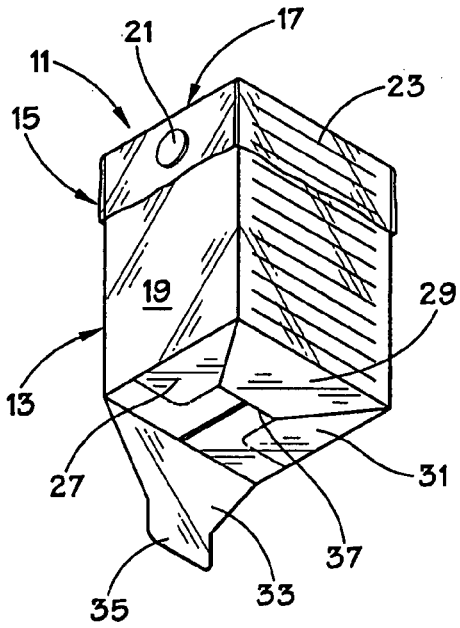
FIG. 4 is a perspective view of the foldable measuring container of FIG. 1 in a substantially volume-defining configuration according to the present invention.

FIG. 4 is a perspective view of a foldable measuring container according to the present invention. Box 13 is substantially in the volume-defining configuration. Flaps 27, 29, and 31 are folded such that they form slot 37, into which tongue 35 of flap 33 can be inserted.

FIG. 5 is a front view of a foldable measuring container according to the present invention. Bag 15 may be inserted into box 13 before using container 11 for a first time. Alternatively, bag 15 may be replaced each time container 11 is used so as to increase sanitation and reduce the need to rinse container 11 after use.

FIG. 6 is a perspective view of a foldable measuring container according to the present invention. Container 41 includes box 43 and bag 45. Bag 45 is sized to line interior 47 of box 43. Bag 45 preferably is composed of a liquid-impermeable, substantially transparent plastic. More preferably, bag 45 is composed of a liquid-impermeable, clear plastic and has a shape that conforms to the shape of interior 47 of box 43. Bag 45 may be attached to interior 47 or, more preferably, exterior 49 of box 43 by adhesive 51. Adhesive 51 may be applied in one or more locations, the specific locations illustrated in FIG. 6 serving only as an example. Adhesive 51, if used, helps to prevent bag 45 from becoming separated from box 43. In an alternative embodiment, a substantial portion of bag 45 may be bonded to box 43. In yet another embodiment, bag 45 may be replaced each time container 41 is used.

Box 43 is illustrated here in a stable, volume-defining configuration, but may be converted to a substantially flat configuration. Although box 43 is illustrated as having a rectangular shape, many shapes of box are within the scope of the invention. Box 43 preferably is composed of a structurally stable material 53. For example, box 43 could be composed of an opaque, liquid-resistant material, such as liquid-resistant paperboard or a plastic material. Box 43 includes window 55. Window 55 preferably is composed of a substantially transparent material such as plastic, and most preferably from a clear plastic. Window 55 may be bonded to material 53 using glue or other means as understood by those of skill in the art. Box 43 includes one or more graduations 57 adapted to indicate the volume of liquid in container 41 when box 43 is in the volume-defining configuration. Graduations 57 preferably are printed on either side of window 55, or are imprinted into window 55. Those of skill in the art will recognize that any means for providing graduations is within the scope of the invention. For example, graduations 57 could be printed on exterior 49 of box 43 adjacent window 55. Window 55 preferably extends from upper edge 59 to lower edge 61 of box 43 such that substantially the entire volume of container 41 may be measured easily. Container 41 preferably has a liquid capacity of about one liter when box 43 is in the volume-defining configuration.

Box 43 also includes bottom 63. Bottom 63 preferably includes at least two flaps adapted to interlock when box 43 is in the volume-defining configuration. Bottom 63 of box 43 as illustrated in FIG. 6 includes flaps 65, 67, 69, and 71. Flap 71 includes tongue 73. Flaps 65, 67, and 69 are adapted to form slot 75 when folded together. Tongue 73 of flap 71 is adapted to be inserted into slot 75 when box 43 is in the volume-defining configuration. The arrangement of flaps of bottom 63 preferably confers sufficient stability to box 43 that it can be handled confidently with only one hand. Although a specific design for bottom 63 is disclosed in detail herein, other designs for bottom 63 that are foldable and provide sufficient rigidity are within the scope of invention, as understood by those of skill in the art. The side of box 43 opposite bottom 63 preferably is left open, but could be fitted with a lid or additional flaps.

FIG. 7 is a perspective view of a foldable measuring container according to the present invention. In this illustration, box 43 is in a substantially flat configuration. Container 41 may be conveniently stored, shipped, or carried in the flat configuration. Bag 45 need not be removed from box 43 when in the flat configuration. The folding of flaps 65, 67, 69, and 71 are the same as described in regard to FIGS. 3 and 4 above. Furthermore, as described in regard to FIG. 5 above, bag 45 may be inserted into box 43 before using container 41 for a first time. Alternatively, bag 45 may be replaced each time container 41 is used so as to increase sanitation and reduce the need to rinse container 41 after use.

In the drawings and specification, there have been disclosed embodiments of the invention and, although specific terms are employed, they are used in a generic and descriptive sense only and not for the purpose of limitation, the scope of the invention being set forth in the following claims.

What claimed is:

1. A urine measuring container adapted to measure a volume of urine, which has been urinated into the container, comprising:

a box convertible between a substantially flat configuration and a stable, volume-defining configuration, the box having a window, an open top, a bottom, an interior, and an exterior;

the bottom of the box comprises at least two flaps adapted to interlock when the box is in the volume-defining configuration;

a liquid-impermeable, substantially transparent bag lining, and conforming to, the interior of the box, and a portion of the bag extends outwardly through the top of the box and contacts the exterior of the box; wherein the bag is attached to the exterior of the box with an adhesive; and one or more graduations adapted to indicate the volume of liquid in the container when the box is in the volume-defining configuration.

2. The container of claim 1 wherein the window extends from an upper edge of the box to a lower edge of the box when the box is in the volume-defining configuration.

3. The container of claim 1 wherein the box is comprised of an opaque liquid-resistant paperboard material.

4. The container of claim 1 wherein one of the at least two flaps includes a tongue adapted to be inserted into a slot.

5. The container of claim 1 wherein a bottom of the box comprises a first, second, and third flaps adapted to form a slot and a fourth flap including a tongue adapted to be inserted into the slot when the box is in the volume-defining configuration.

6. The container of claim 1 wherein the container has a maximum liquid capacity of about one liter when the box is in the volume-defining configuration.

7. The container of claim 1 wherein the bag is comprised of a clear plastic material.

8. The container of claim 1 wherein the window is comprised of a substantially transparent material.

9. The container of claim 8 wherein the substantially transparent material comprises a clear plastic material.

10. A urine measuring container adapted to measure a volume of urine, which has been urinated into the container, comprising:

a substantially transparent plastic box, having an open top, a bottom, an interior, and an exterior, convertible between a substantially flat configuration and a stable, volume-defining configuration;

the bottom of the box comprises at least two flaps adapted to interlock when the box is in the volume-defining configuration;

a substantially transparent plastic bag lining, and conforming to, the interior of the box, and a portion of the bag extends outwardly through the top of the box and contacts the exterior of the box; wherein the bag is attached to the exterior of the box with an adhesive; and one or more graduations adapted to indicate the volume of liquid in the container when the box is in the volume-defining configuration.

11. The container of claim 10 wherein one of the at least two flaps includes a tongue adapted to be inserted into a slot.

12. The container of claim 10 wherein a bottom of the box comprises a first, second, and third flaps adapted to form a slot and a fourth flap including a tongue adapted to be inserted into the slot when the box is in the volume-defining configuration.

13. The container of claim 10 wherein the container has a maximum liquid capacity of about one liter when the box is in the volume-defining configuration.

14. A foldable urine measuring container adapted to measure a volume of urine, which has been urinated into the container, comprising:

a clear plastic box, having an open top, a bottom, an interior, and an exterior convertible between a substantially flat configuration and a stable, volume-defining configuration, the bottom of the box including a first, second, and third flaps adapted to form a slot and a fourth flap including a tongue adapted to be inserted into the slot when the box is in the volume-defining configuration;

a clear plastic bag lining, and conforming to, the interior of the box, and a portion of the bag extends outwardly through the top of the box and contacts the exterior of the box; wherein the bag is attached to the exterior of the box with an adhesive; and one or more graduations adapted to indicate the volume of liquid in the container when the box is in the volume-defining configuration.

15. The container of claim 14 wherein the container has a maximum liquid capacity of about one liter when the box is in the volume-defining configuration.

* * * * *